US006698238B1

(12) United States Patent
Cheng

(10) Patent No.: US 6,698,238 B1
(45) Date of Patent: Mar. 2, 2004

(54) BEADED NECKLACE ENHANCER

(76) Inventor: Howard S. Cheng, 2821 S. Quinn St., Chicago, IL (US) 60608

( * ) Notice: Subject to any disclaimer, the term of this patent is extended or adjusted under 35 U.S.C. 154(b) by 0 days.

(21) Appl. No.: 10/286,500

(22) Filed: Nov. 1, 2002

(51) Int. Cl.[7] ..... A44C 25/00

(52) U.S. Cl. ..... 63/23; 63/3; 63/3.1; 24/116 A; 24/574.1

(58) Field of Search ..... 63/3, 3.1, 3.2, 63/21, 23; 24/116 A, 574.1

(56) References Cited

U.S. PATENT DOCUMENTS

| | | | | | |
|---|---|---|---|---|---|
| 295,869 | A | * | 3/1884 | Herring | 63/21 |
| 1,578,940 | A | * | 3/1926 | Wacha | 24/116 A |
| 1,746,054 | A | * | 2/1930 | Ridabock | 63/33 |
| 2,051,591 | A | * | 8/1936 | Brogan | 24/116 A |
| 2,298,591 | A | * | 10/1942 | Ross | 59/80 |
| 2,427,117 | A | * | 9/1947 | Barmache et al. | 59/80 |
| 2,644,992 | A | * | 7/1953 | McFarland | 24/116 A |
| 3,114,187 | A | * | 12/1963 | Wayne | 24/116 A |
| 3,122,900 | A | * | 3/1964 | Beghetto, Jr. | 63/23 |
| 4,530,221 | A | * | 7/1985 | Weinberg | 63/3.2 |
| 5,214,940 | A | * | 6/1993 | Capifali | 63/21 |
| 6,006,547 | A | * | 12/1999 | Bergagnini | 63/26 |
| 6,317,935 | B1 | * | 11/2001 | O'Rouke | 24/129 R |
| 6,357,261 | B1 | * | 3/2002 | Cheng | 63/3.1 |
| 6,389,655 | B2 | * | 5/2002 | Libecco | 24/300 |
| 6,484,376 | B1 | * | 11/2002 | Khatchadourian et al. | 24/658 |

* cited by examiner

*Primary Examiner*—J. J. Swann
*Assistant Examiner*—Andrea Chop
(74) *Attorney, Agent, or Firm*—Andrus, Sceales, Starke & Sawall

(57) ABSTRACT

A jewelry pendant for attachment to a strand of beads having a first and second countersink on opposite sides of the upper attachment end of the jewelry pendant. The countersinks are coupled at a junction to define an aperture through the upper attachment end of the jewelry pendant. The aperture is large enough to permit passage of a connector on a strand of beads and being smaller than the diameter of the end beads.

7 Claims, 2 Drawing Sheets

BEADED NECKLACE ENHANCER

BACKGROUND OF THE INVENTION

The present invention relates to a jewelry pendant and, in particular, a jewelry pendant for attachment to a strand of beads, or the like, wherein a pair of end beads are closely coupled to one another via countersinks on an attachment end of the jewelry pendant.

There is a continuing need for improvements in jewelry components that enable removable suspension of a pendant from a strand of beads, or the like. Conventional designs for jewelry pendants for attachment to a strand of beads generally comprise a design in which the pendant is supported by the strand at a location between two of the beads on the strand. However, in such conventional settings, no portion of the beads are coupled to or joined with the pendant. As a result, the pendant must have a hole large enough to be threaded onto the necklace. This may then require a larger than desirable hole in the pendant and, further, the pendant can slide along the strand from a desired center strand position.

Accordingly, it is desirable to provide a jewelry pendant for attachment to a strand of beads, or the like, that allows each of two end beads on the strand to be coupled to an attachment end of the jewelry pendant.

The present invention is particularly suited for use with an invisible connector assembly for a beaded strand of jewelry, such as the one disclosed in Cheng U.S. Pat. No. 6,357,261. This type of connector for jewelry strands attaches and interconnects with two end beads of a beaded strand or the like.

SUMMARY OF THE INVENTION

In accordance with the present invention, a jewelry pendant is attached to and interconnects with two end beads of a beaded strand or the like. A first and second countersink are bored into opposing sides of an upper attachment end of the jewelry pendant. The two countersinks are connected at a junction by an aperture through the upper attachment end. The aperture is large enough to permit passage of a connector for the strand and yet smaller than the diameter of either of the end beads.

DETAILED DESCRIPTION OF THE PREFERRED EMBODIMENT

Figure 1:
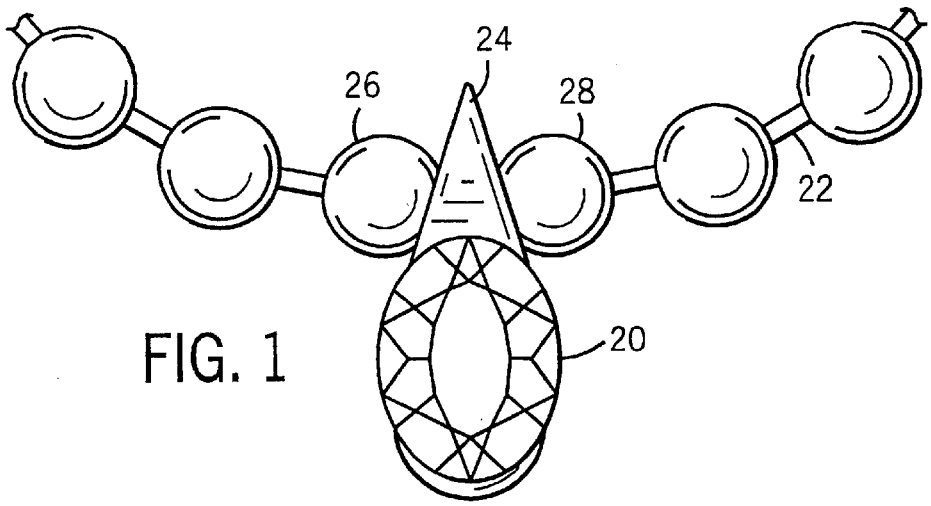
FIG. 1 is a front view showing one embodiment of the jewelry pendant of the present invention and a portion of a strand of beads.

In FIG. 1, the jewelry pendant 20 of the present invention is attached to a strand of beads 22. The jewelry pendant 20 includes an upper attachment end 24. The strand of beads 22 includes first and second end beads 26, 28.

Figure 2:
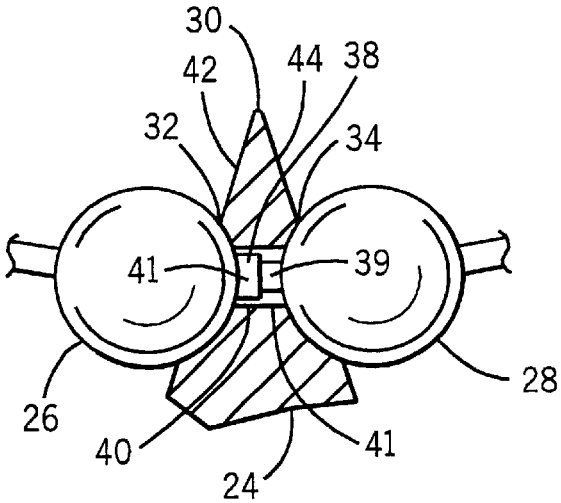
FIG. 2 is an enlarged sectional front view of the pendant shown in FIG. 1, showing one embodiment of the upper attachment end of the jewelry pendant of the present invention and two end beads of the strand of beads.

Referring to FIG. 2, an enlarged sectional front view shows one. embodiment of the upper attachment end 24 of the jewelry pendant 20 and first and second end beads 26, 28 of the strand of beads 22. The upper attachment end 24 has a substantially tapered end 30. The first and second end beads 26, 28 reside in first and second countersinks 32, 34, respectively. The first and second countersinks 32, 34 are depicted as being semi-spherical, however, they can be formed in any of a variety of shapes. The first and second countersinks 32, 34 may also be of equal or differing dimensions. The first and second end beads 26, 28 are joined by a connector 38 which passes through an aperture 40 existing at a junction 41 between the first and second countersinks 32, 34 in the upper attachment end 24. The first and second countersinks 32, 34 are on substantially opposing first and second sides 42, 44 of the upper attachment end 24. A particularly suitable connector for the strand of beads is that shown in the above identified patent in which a threaded stud 39 carried on bead 28 is threaded into a tapped bore in a metal post 41 carried by the other end bead 26. This allows the end beads to be snuggly held in the countersinks 32 and 34.

Figure 3:
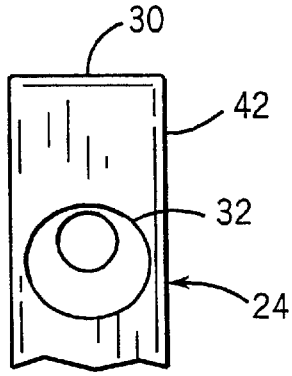
FIG. 3 is a side view showing the countersink in the upper attachment end shown in FIG. 2.

Referring to FIG. 3, a side view of the first side 42 of the upper attachment end 24 depicted in FIG. 2 is shown. The upper attachment end 24 has a first countersink 32 and a substantially tapered end 30.

Figure 4:
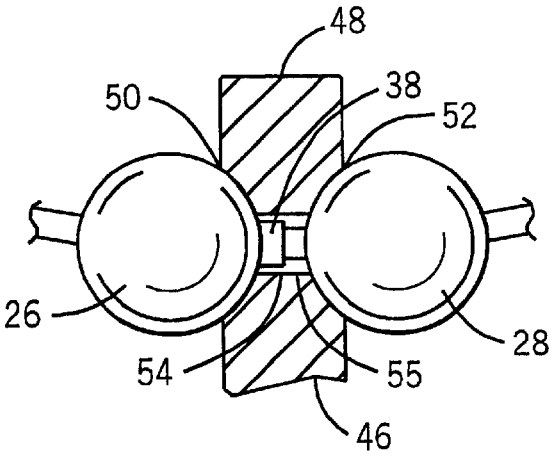
FIG. 4 is a sectional front view showing another embodiment of the attachment end of the jewelry pendant of the present invention and two end beads of the strand of beads.

FIG. 4 shows another embodiment of the jewelry pendant 20 of the present invention. In this embodiment, the upper attachment end 46 has a substantially rectangular end 48. As can be seen, the upper attachment end 46 has first and second countersinks 50, 52, and an aperture 54 formed by a junction 55 between the first and second countersinks 50, 52. Also shown are first and second end beads 26, 28 joined by a connector 38 which passes through the aperture 54 between the first and second countersinks 50, 52.

Figure 5:
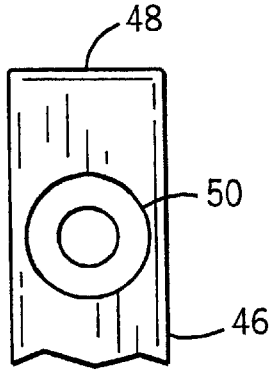
FIG. 5 is an enlarged side view, showing a countersink in the upper attachment end shown in FIG. 4.

Referring to FIG. 5, a side view of the upper attachment end 46 depicted in FIG. 4 is shown. The upper attachment end 46 has a substantially rectangular end 48 and a first countersink 50.

There are various methods known in the art for making the jewelry pendant 20 of the present invention. Some possible variations in the jewelry pendant 20 are described with reference to FIGS. 6–8.

Figure 6:
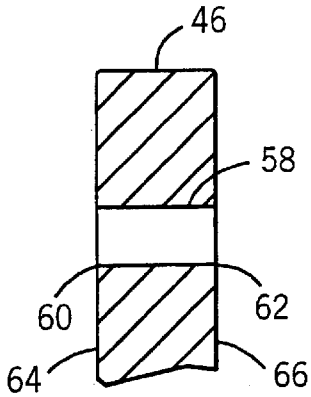
FIG. 6 is a sectional front view of a thru-bore formed through the upper attachment end shown in FIG. 4.
Figure 7:
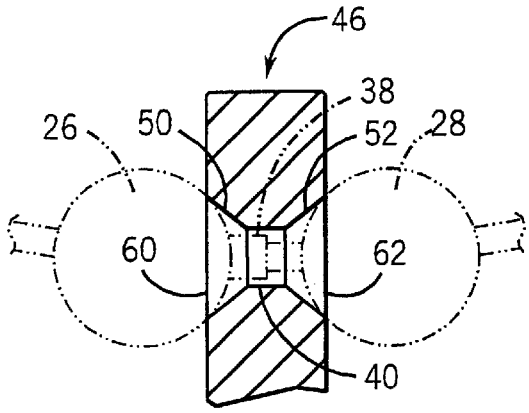
FIG. 7 is an enlarged sectional front view showing first and second countersinks formed at opposing first and second ends of the thru-bore shown in FIG. 6.

As shown in FIG. 6, a thru-bore 58 can be bored through the upper attachment end 46 of the embodiment depicted in FIGS. 4 and 5, the thru-bore 58 having first and second openings 60, 62 on opposing sides 64, 66 of the upper attachment end 46. Referring then to FIG. 7, first and second countersinks 50, 52 are bored in substantially opposing sides 64, 66 of the upper attachment end 46 using the first and second openings 60, 62 of the thru-bore 58 as a guide point. Once the first and second countersinks 50, 52 are formed, end beads 26,28 on the strand of beads 22 are fit into the first and second countersinks 50, 52, respectively, and connected by the connector 38 which passes through the aperture 40 formed between the first and second countersinks 50, 52.

Figure 8:
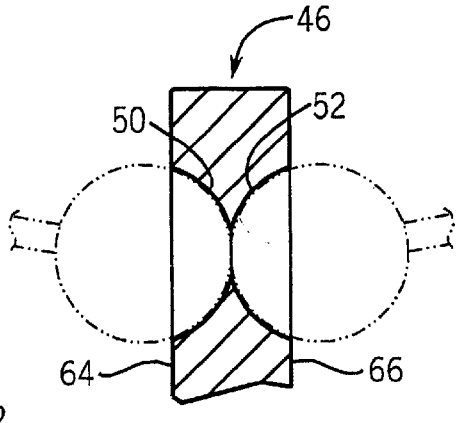
FIG. 8 is a sectional front view showing two opposing countersinks formed at opposing first and second sides of the upper attachment end shown in FIG. 4.

Alternatively, as can be seen in FIG. 8, first and second countersinks 50, 52 can be bored directly into substantially opposing first and second sides 60, 62 of the upper attachment end 46 without using a thru-bore 58 to guide the drilling.

Figure 9:
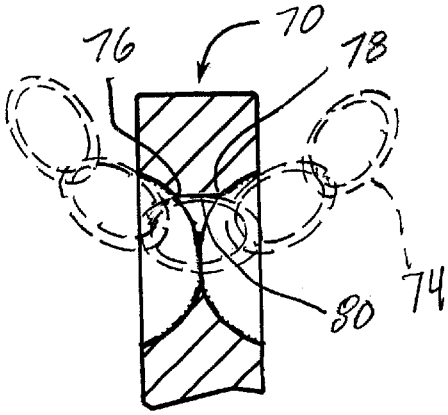
FIGS. 9 and 10 show an alternate embodiment of the pendant constructed to also accommodate a conventional necklace.
Figure 10:
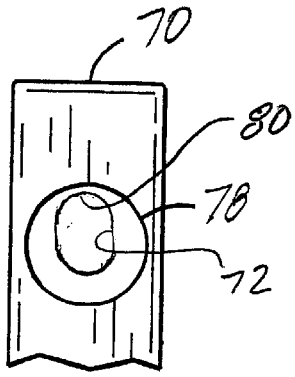

The owner of a pendant may desire to wear it with a necklace other than a beaded strand. In such case, however, the thru-bore through the pendant must be large enough to accommodate the maximum size of the other type of necklace. In FIGS. 9 and 10, there is shown an embodiment of a pendant having an upper attachment end 70 that is similar to the FIG. 8 embodiment, but includes an enlarged thru-bore 72 that will accommodate the passage of a necklace chain 74, but will also accommodate a beaded strand joined by a small connector 38 as previously described. The attachment end 70 of the pendant in FIGS. 9 and 10 includes first and second countersinks 76 and 78 to accommodate the end beads 26 and 28 of a beaded strand, but also includes the enlarged oval shaped thru-bore 72 the upper edge of which defines a flat 80. The enlarged thru-bore 72, which is offset upwardly with respect to the junction between the first and second countersinks, will readily accommodate passage of a necklace chain 74, including the connectors on its opposite ends. In addition, the flat 80 formed at the upper end of the enlarged oval thru-bore 72 provides a bearing surface for the pendant on the chain 74 that causes the pendant to hang better on the chain than it would with the rather sharp edge of the thru-bore shown, for example, in FIG. 8.

It will thus be seen that the objects set forth above, among those made apparent from the preceding description, are efficiently attained, and since certain changes may be made in the design and construction set forth, without departing from the spirit and scope of the invention, it is intended that all matter contained in this description and shown in the drawings shall be interpreted as illustrative and not in a limiting sense.

It is also to be understood that the following claims are intended to cover all of the generic and specific features of the invention herein described, and all statements of the scope of the invention, which as a matter of language might be said to fall therebetween.

I claim:

1. A jewelry pendant and a strand of beads for attachment thereto, said beads having a detachable connector for a pair of end beads on the strand, the pendant comprising:

a body having an upper attachment end, the upper attachment end including a first countersink and a second countersink, wherein the first countersink and the second countersink are on substantially opposite sides of the upper attachment end and are coupled at a junction at which the surfaces of the countersinks overlap to define an aperture through the upper attachment end, the aperture being large enough to permit passage of the connector and being smaller than the diameter of the end beads, the surfaces of the countersinks providing bearing surfaces for said end beads when connected.

2. The jewelry pendant of claim 1 wherein the first and second countersinks are of equal dimensions.

3. The jewelry pendant of claim 1 wherein the first and second countersinks are conical in shape.

4. The jewelry pendant of claim 1 wherein the first and second countersinks are spherical in shape.

5. The jewelry pendant of claim 1 wherein the upper attachment end is substantially rectangular.

6. The jewelry pendant of claim 1 wherein the upper attachment end is substantially tapered.

7. The jewelry pendant of claim 1 wherein the aperture has a generally oval shape and is offset upwardly with respect to the junction between the first and second countersinks to define a flat upper support surface.

* * * * *